US007883452B1

(12) United States Patent
Chen

(10) Patent No.: US 7,883,452 B1
(45) Date of Patent: Feb. 8, 2011

(54) KETTLEBELL HAVING PIVOTAL HANDLE

(76) Inventor: Paul Chen, 7771 Goldstream Dr., Richmond, Vancouver, BC (CA) V7A 1S5

( * ) Notice: Subject to any disclaimer, the term of this patent is extended or adjusted under 35 U.S.C. 154(b) by 0 days.

(21) Appl. No.: 12/800,100

(22) Filed: May 7, 2010

(51) Int. Cl.
*A63B 21/06* (2006.01)
*A63B 21/075* (2006.01)

(52) U.S. Cl. ..... 482/93; 482/108

(58) Field of Classification Search ..... 482/93, 482/106–109, 44, 49–50
See application file for complete search history.

(56) References Cited

U.S. PATENT DOCUMENTS

| | | | | |
|---|---|---|---|---|
| 1,316,683 | A * | 9/1919 | Calvert | 482/93 |
| 1,917,566 | A | 7/1933 | Wood | |
| 4,659,079 | A | 4/1987 | Blanchard | |
| 5,312,308 | A * | 5/1994 | Hamilton et al. | 482/44 |
| 6,387,022 | B1 | 5/2002 | Smith | |
| 7,052,445 | B2 | 5/2006 | Ekhaus | |
| 7,182,715 | B2 | 2/2007 | Anderson | |
| 7,381,157 | B2 | 6/2008 | Blateri | |
| 7,491,157 | B1 | 2/2009 | Lin | |
| 7,563,208 | B1 * | 7/2009 | Chen | 482/93 |
| 2007/0135274 | A1 * | 6/2007 | Blateri | 482/109 |
| 2008/0081744 | A1 * | 4/2008 | Gormley | 482/93 |
| 2010/0120589 | A1 * | 5/2010 | Krull | 482/93 |

* cited by examiner

*Primary Examiner*—Fenn C Mathew
(74) *Attorney, Agent, or Firm*—Charles E. Baxley

(57) ABSTRACT

A kettlebell includes a kettle member having a pivotal coupling member, and a handle having another pivotal coupling member pivotally engaged with the pivotal coupling member of the kettle member, and the kettle member and the handle include guide members engaged with each other for limiting and guiding the kettle member to rotate relative to the handle along a longitudinal axis of the handle and for preventing the kettle member from pivoting and rotating relative to the handle along the lateral axis of the handle, and for preventing the user from being twisted or hit or hammered or hurt by the kettle member of the kettlebell inadvertently.

4 Claims, 5 Drawing Sheets

KETTLEBELL HAVING PIVOTAL HANDLE

BACKGROUND OF THE INVENTION

1. Field of the Invention

The present invention relates to a kettlebell, and more particularly to a kettlebell including a pivotal handle pivotally or rotatably coupled to a weight member or kettle ball or kettle member for allowing the kettlebell to be easily and suitably operated by the user and for preventing the user from being twisted or hit or hammered or hurt by the kettlebell.

2. Description of the Prior Art

Typical kettlebells comprise one or more weight members or kettle balls or kettle members to be secured together, and a normally U or C-shaped handle attached or mounted or secured to the weight members or kettle balls or kettle members for being held or grasped or carried by the user.

For example, U.S. Pat. No. 1,917,566 to Wood, U.S. Pat. No. 4,659,079 to Blanchard, U.S. Pat. No. 6,387,022 to Smith, U.S. Pat. No. 7,052,445 to Ekhaus, U.S. Pat. No. 7,182,715 to Anderson, U.S. Pat. No. 7,381,157 to Blateri, U.S. Pat. No. 7,491,157 to Lin, and U.S. Pat. No. 7,563,208 to Chen disclose several of the typical kettlebells each also comprising a normally U or C-shaped handle including two legs or limbs attached or mounted or secured to the weight members or kettle balls or kettle members for being held or grasped or carried by the user and for allowing the user to conduct various kinds of exercise operations.

However, the handle is solidly attached or mounted or secured to the weight members or kettle balls or kettle members and may not be pivoted or rotated relative to the weight members or kettle balls or kettle members, and the hands of the user may have a good chance to be twisted or hurt by the typical kettlebell inadvertently while the typical kettlebell is operated by the users.

It is to be noted that the kettle members normally include a great weight, and a great torque may be generated and may be applied onto the hand of the user when the kettle member is moved or elevated sidewise or forwardly or rearwardly such that the hands of the user may have a good chance to be twisted or hurt by the typical kettlebell inadvertently.

The present invention has arisen to mitigate and/or obviate the afore-described disadvantages of the conventional exercise devices or kettlebells.

SUMMARY OF THE INVENTION

The primary objective of the present invention is to provide a kettlebell or exercise device including a pivotal handle pivotally or rotatably coupled to a weight member or kettle ball or kettle member for allowing the kettlebell to be easily and suitably operated by the user and for preventing the user from being twisted or hit or hammered or hurt by the kettlebell.

In accordance with one aspect of the invention, there is provided a kettlebell comprising a kettle member including a first pivotal coupling member, and including a first guide member, and a handle including a longitudinal axis and a lateral axis, and including a second pivotal coupling member pivotally engaged with the first pivotal coupling member for pivotally coupling the handle to the kettle member and for allowing the handle to be pivoted relative to the kettle member, and including a second guide member slidably engaged with the first guide member of the kettle member for limiting and guiding the kettle member to rotate relative to the handle along the longitudinal axis and for preventing the kettle member from pivoting and rotating relative to the handle along the lateral axis.

The second pivotal coupling member includes a casing and a compartment formed in the casing for forming a ball socket and for engaging with the first pivotal coupling member which is a ball joint. For example, the first pivotal coupling member or the ball joint may include a stem extended from the ball joint and engaged into and secured to the kettle member.

The handle includes a cover attached onto the casing for blocking the compartment of the casing, and the second guide member of the handle is a channel formed in the cover and communicative with the compartment of the casing, and the first guide member of the kettle member is a key slidably engaged with the channel of the cover of the casing.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
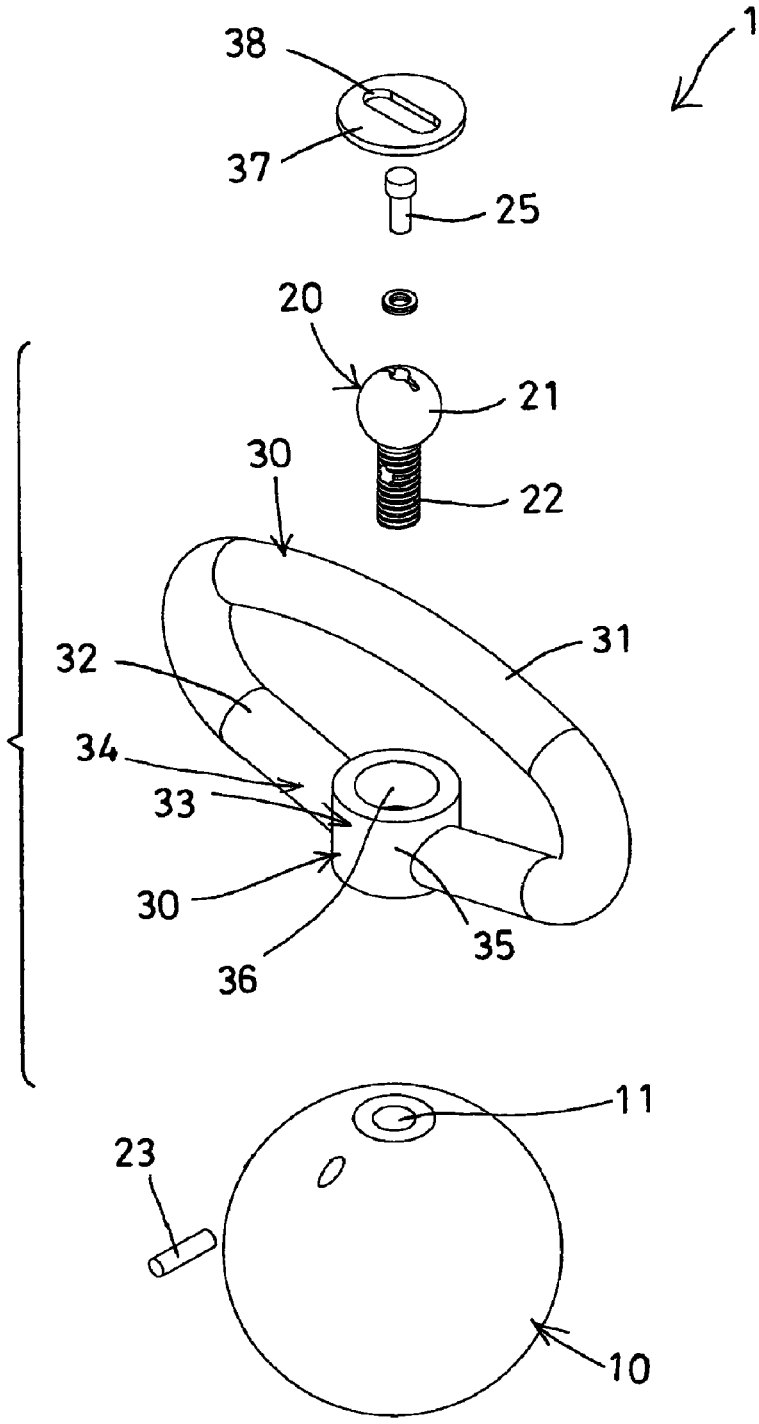
FIG. 1 is a partial exploded view of a kettlebell in accordance with the present invention.
Figure 3:
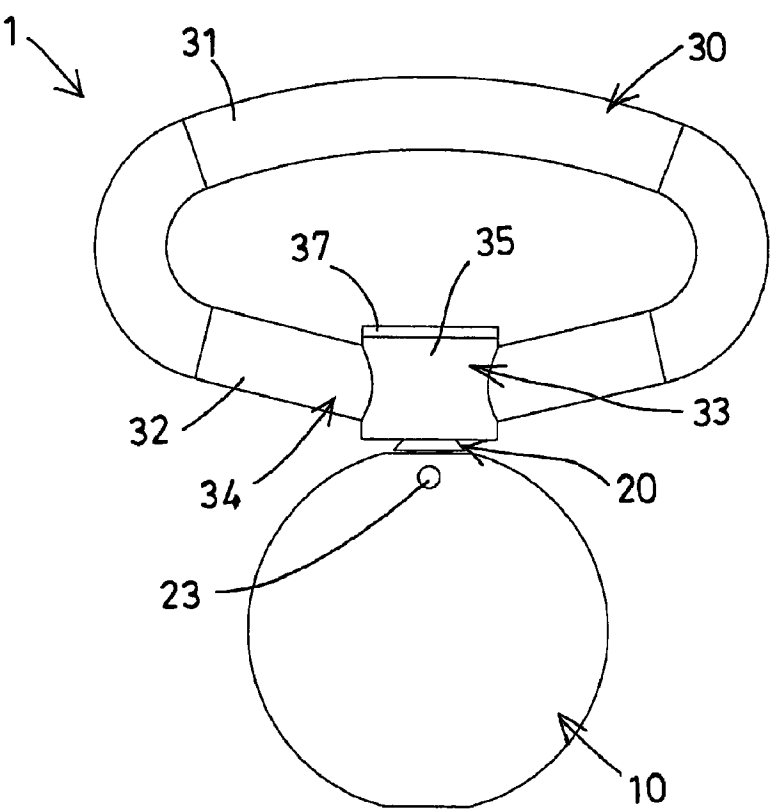
FIG. 3 is a front plan schematic view of the kettlebell.

Referring to the drawings, and initially to FIGS. 1-5, a kettlebell 1 in accordance with the present invention comprises a kettle ball or kettle member 10 which may include an adjustable structure having one or more weight plates or weight members (not shown) selectively or changeably mounted or coupled or secured together to form the kettle ball or kettle member 10, however, the adjustable structure of the kettle ball or kettle member 10 is typical and is not related to the present invention and will not be described in further details. The kettle member 10 includes an orifice 11 formed therein, such as formed in the upper portion thereof for attaching or mounting or securing a pivotal coupling member 20 to the kettle member 10.

For example, the pivotal coupling member 20 includes a spherical or ball-shaped joint member 21, and a stem 22 formed on or extended downwardly from the ball-shaped joint member 21 and threaded or engaged into the orifice 11 of the kettle member 10, and the stem 22 may further be solidly attached or mounted or secured to the kettle member 10 with one or more latches or fasteners 23, the stem 22 and/or the ball-shaped joint member 21 may also be solidly attached or mounted or secured to the kettle member 10 with adhesive materials, by welding processes or the like and formed integral with the kettle member 10, or the kettle member 10 may include the ball-shaped joint member 21 integrally formed or provided thereon.

The kettlebell 1 further comprises a handle 30 pivotally or rotatably coupled to the kettle member 10 for allowing the kettlebell 1 to be easily and suitably operated by the user and for preventing the user from being hurt by the kettlebell 1. For example, the handle 30 includes a substantially "O" or closed loop shaped structure having an upper handlebar 31 and a lower handlebar 32, and/or includes another pivotal coupling member 33, such as a ball socket 33 attached or mounted or coupled or secured to or formed on the lower portion 34 of the handle 30. For example, the other pivotal coupling member or ball socket 33 includes a casing 35 having a substantially spherical shaped socket opening or compartment 36 formed in the casing 35 for pivotally or rotatably receiving or engaging with the ball-shaped joint member 21 and for allowing the handle 30 to be pivoted or rotated relative to the kettle member 10 for 360 degrees.

The handle 30 further includes a cover 37 attached or mounted or secured onto the casing 35 for blocking or enclosing the spherical shaped socket opening or compartment 36 of the casing 35, and the cover 37 includes a limit or guide member 38, such as an oblong hole or channel 38 formed therein and communicative with the compartment 36 of the casing 35, and the kettle member 10 further includes another limit or guide member 25, such as a key 25 attached or mounted or secured to the joint member 21 and slidably engaged with or in the channel 38 of the cover 37 or of the casing 35 or of the handle 30 for limiting or guiding the kettle member 10 to pivot or rotate relative to the handle 30.

Figure 2:
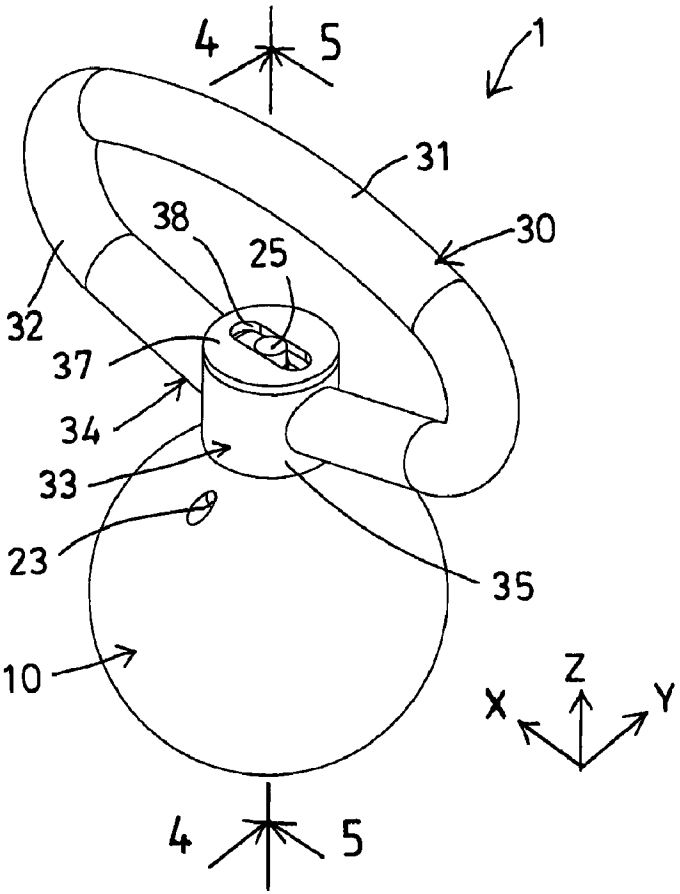
FIG. 2 is a perspective view of the kettlebell.
Figure 5:
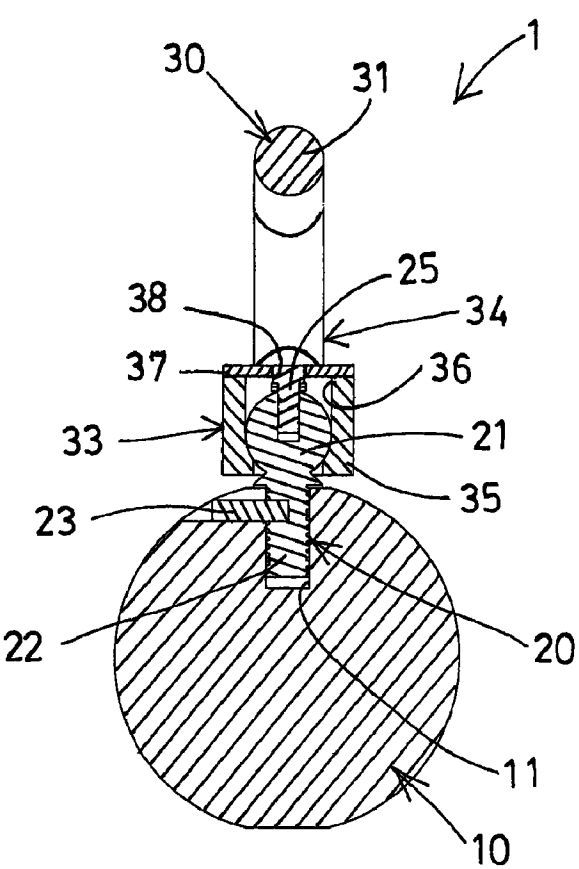
FIGS. 4, 5 are cross sectional views of the kettlebell taken along lines 4-4, and 5-5 of FIG. 2 respectively.
Figure 4:
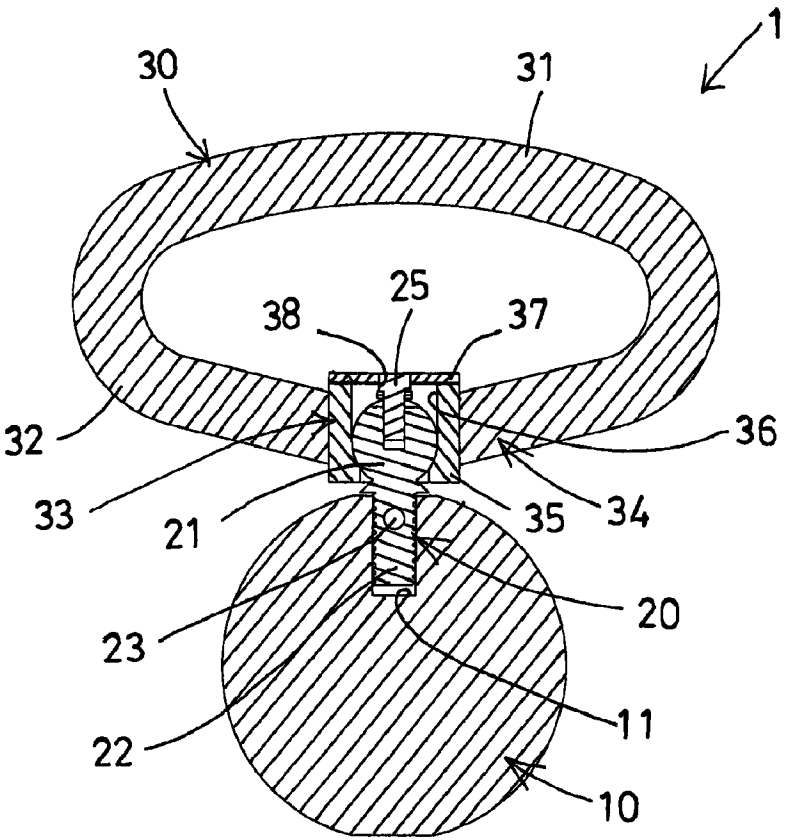
Figure 6:
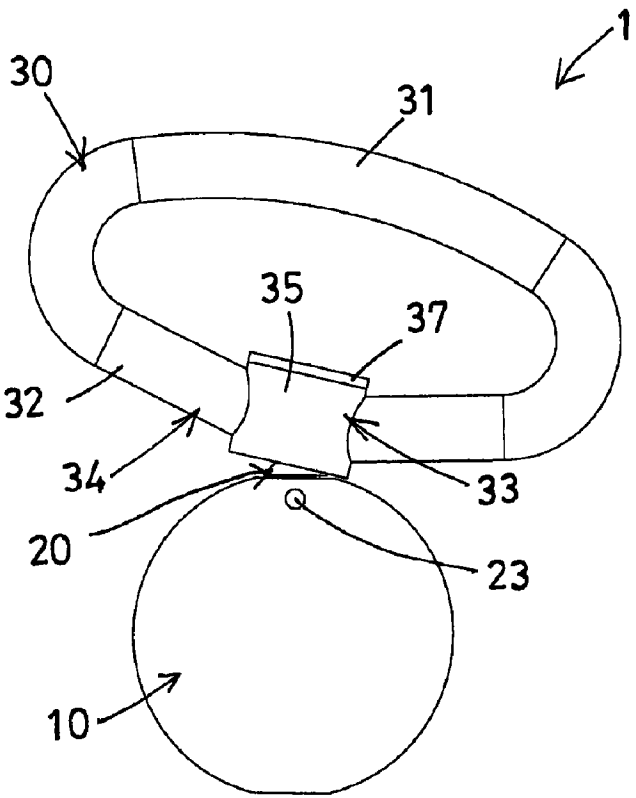
FIGS. 6, 7 are front plan schematic views similar to FIG. 3 illustrating the operation of the kettlebell.
Figure 7:
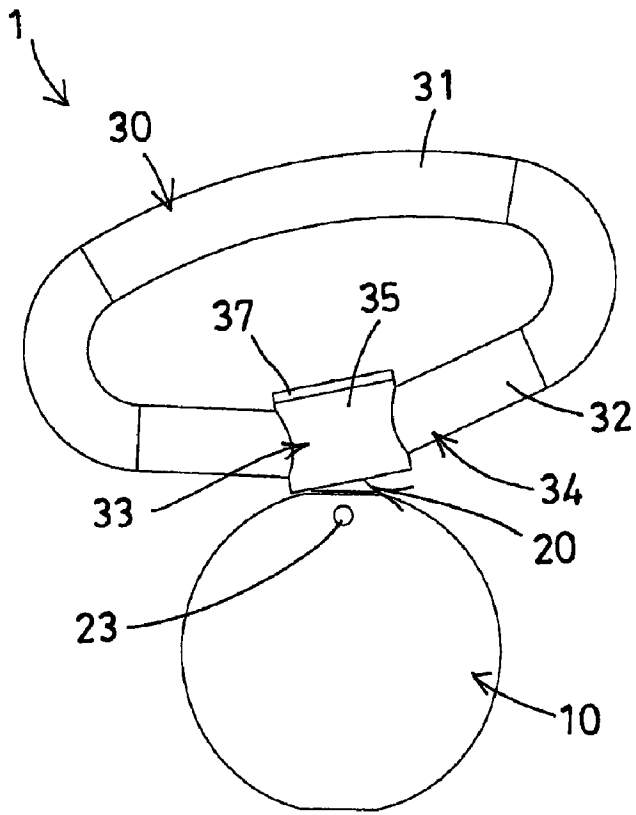
Figure 8:
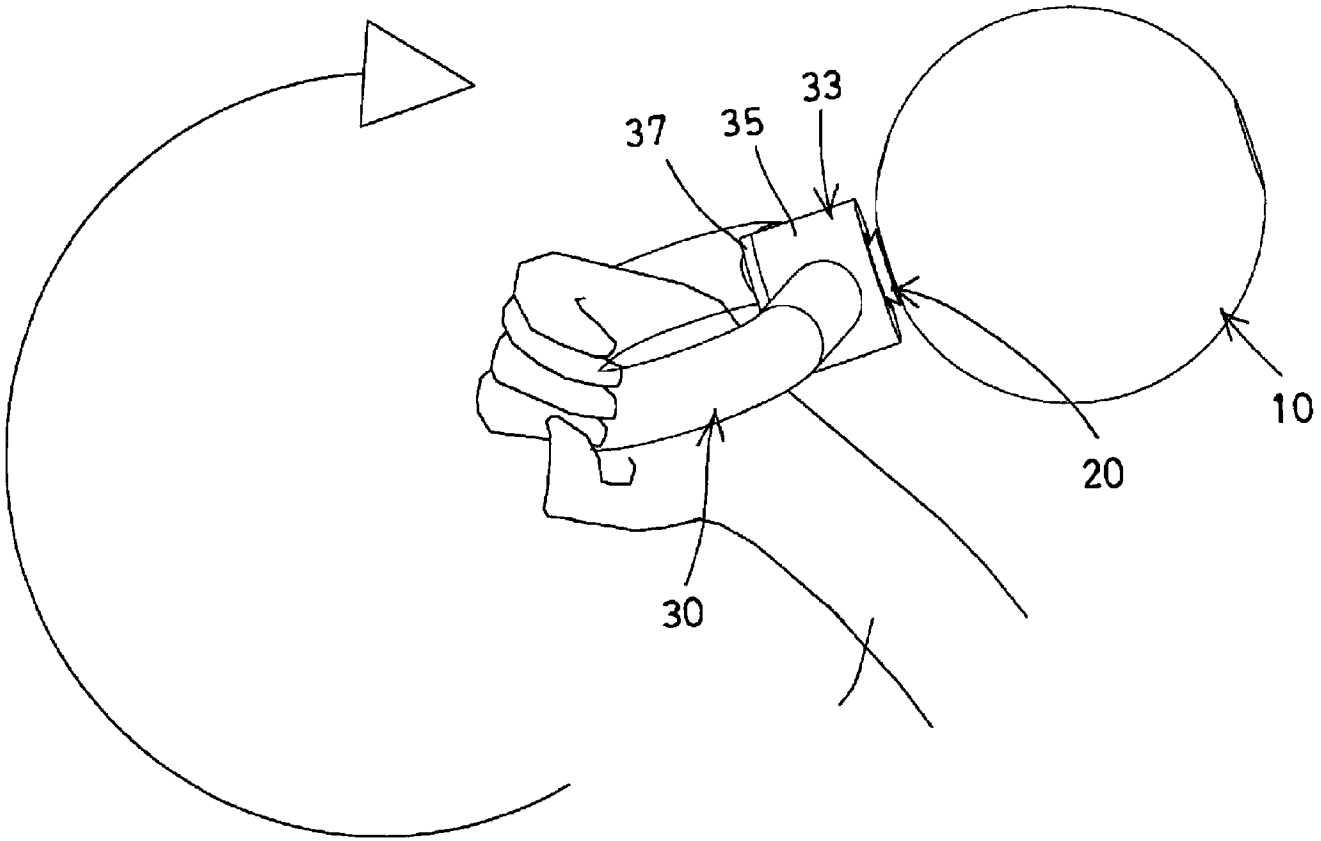
FIG. 8 is are partial perspective views illustrating the operation of the kettlebell.

As shown in FIG. 2, the channel 38 of the cover 37 or of the casing 35 or of the handle 30 is formed and extended along the longitudinal or X-axis of the handle 30, and the guide member 25 and thus the kettle member 10 may be limited or guided to pivot or rotate relative to the handle 30 along the longitudinal or X-axis of the handle 30 (FIGS. 3, 6-7), and may be prevented from pivoting or rotating relative to the handle 30 along the lateral or Y-axis, and thus may prevent the kettle member 10 from pivoting or rotating relative to the handle 30 and to hit or strike onto the hand 80 of the user, best shown in FIG. 8. It is to be noted that the kettle member 10 is freely to pivot or rotate relative to the handle 30 for 360 degrees with the joint member 21 and the casing 35 of the pivotal coupling member or ball socket 33 of the handle 30.

In operation, as shown in FIGS. 2-3, and 6-7, the handle 30 may be pivoted or rotated relative to the kettle member 10 in any direction, such as leftward (FIG. 7), rightward (FIG. 6), or spindle relative to the kettle member 10 (FIGS. 3-5), particularly, when the kettle member 10 is moved or elevated sidewise. However, as shown in FIG. 8, the kettle member 10 may be from pivoting or rotating relative to the handle 30 along the Y-axis, and thus may be prevented from pivoting or rotating relative to the handle 30 and to hit or strike onto the hand 80 of the user.

Accordingly, the kettlebell in accordance with the present invention includes a pivotal handle pivotally or rotatably coupled to a weight member or kettle ball or kettle member for allowing the kettlebell to be easily and suitably operated by the user and for preventing the user from being twisted or hit or hammered or hurt by the kettlebell.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A kettlebell comprising:

a kettle member including a first pivotal coupling member, and including a first guide member, and a handle including a longitudinal axis and a lateral axis, and including a second pivotal coupling member pivotally engaged with said first pivotal coupling member for pivotally coupling said handle to said kettle member and for allowing said handle to be pivoted relative to said kettle member, and including a second guide member slidably engaged with said first guide member of said kettle member for limiting and guiding said kettle member to rotate relative to said handle along said longitudinal axis and for preventing said kettle member from pivoting and rotating relative to said handle along said lateral axis.

2. The kettlebell as claimed in claim 1, wherein said second pivotal coupling member includes a casing and a compartment formed in said casing for forming a ball socket and for engaging with said first pivotal coupling member which is a ball joint.

3. The kettlebell as claimed in claim 2, wherein said handle includes a cover attached onto said casing for blocking said compartment of said casing, and said second guide member of said handle is a channel formed in said cover and communicative with said compartment of said casing, and said first guide member of said kettle member is a key slidably engaged with said channel of said cover of said casing.

4. The kettlebell as claimed in claim 2, wherein said ball joint includes a stem secured to the kettle member.

* * * * *